US005093060A

United States Patent [19]

Samuels et al.

[11] Patent Number: 5,093,060

[45] Date of Patent: Mar. 3, 1992

[54] COUPLED SPINNING AND DEWATERING PROCESS

[75] Inventors: Sam L. Samuels, Claymont, Del.; Vaclav G. Zboril, Kingston, Canada

[73] Assignees: E. I. du Pont de Nemours and Company, Wilmington, Del.; Du Pont Canada Inc., Mississauga, Canada

[21] Appl. No.: 659,620

[22] Filed: Feb. 25, 1991

[51] Int. Cl.[5] ..... D01D 5/26

[52] U.S. Cl. ..... 264/143; 264/205; 264/211.14

[58] Field of Search ..... 264/143, 148, 5, 13, 264/14, 83, 205, 211.14

[56] References Cited

U.S. PATENT DOCUMENTS

| | | | |
|---|---|---|---|
| 2,939,177 | 6/1960 | Guentert et al. | 264/143 |
| 3,081,519 | 3/1963 | Blades et al. | 28/81 |
| 3,920,509 | 11/1975 | Yonemori | 162/157 R |
| 4,054,625 | 10/1977 | Kozlowski et al. | 264/13 |
| 4,666,766 | 5/1987 | Brotz | 428/304.4 |
| 5,043,108 | 8/1991 | Samuels | 264/13 |

OTHER PUBLICATIONS

P. S. Zurer, "Search Intensifies for Alternatives to Ozone-Depleting Halocarbons", Chem. & Eng. News, pp. 17-20 (2/8/88).

*Primary Examiner*—Mary Lynn Theisen

[57] ABSTRACT

A continuous process for the manufacture of a fibrous material from a polyolefin. The process comprises feeding a solution of polyolefin dissolved in an organic solvent at elevated temperature and pressure to a spinneret. The exit of the spinneret is the inlet to an elongated vertical tube and is located in an upper section of an elongated vertical vessel. The tube extends for a major portion of the length of the vessel. Solvent is removed from an upper section of the vessel and water is sprayed both down the tube and into the vessel. The strands thus formed are shredded in a self-cleaning self-feeding shredder located at the bottom of the vessel. The shredded fibres and water are conveyed to a second vessel having a baffle located between the inlet and outlet thereof such that the shredded fibrous material passes from the inlet, over the baffle and to the outlet of the second vessel, the upper lip of the baffle being so that the level of water in the second vessel is in substantially the same horizontal plane as the shredder. An inert gas e.g. steam, is fed to the second vessel to effect removal of volatile matter. The shredded fibres and liquid passing from the second vessel are fed to a dewatering device. The process may be used to manufacture fibrous polyolefin products e.g. the form of a pulp. The preferred polyolefin is a high molecular weight homopolymer of ethylene or copolymer of ethylene and at least one $C_4$-$C_{10}$ hydrocarbon alpha-olefin.

10 Claims, 1 Drawing Sheet

COUPLED SPINNING AND DEWATERING PROCESS

Figure 1:
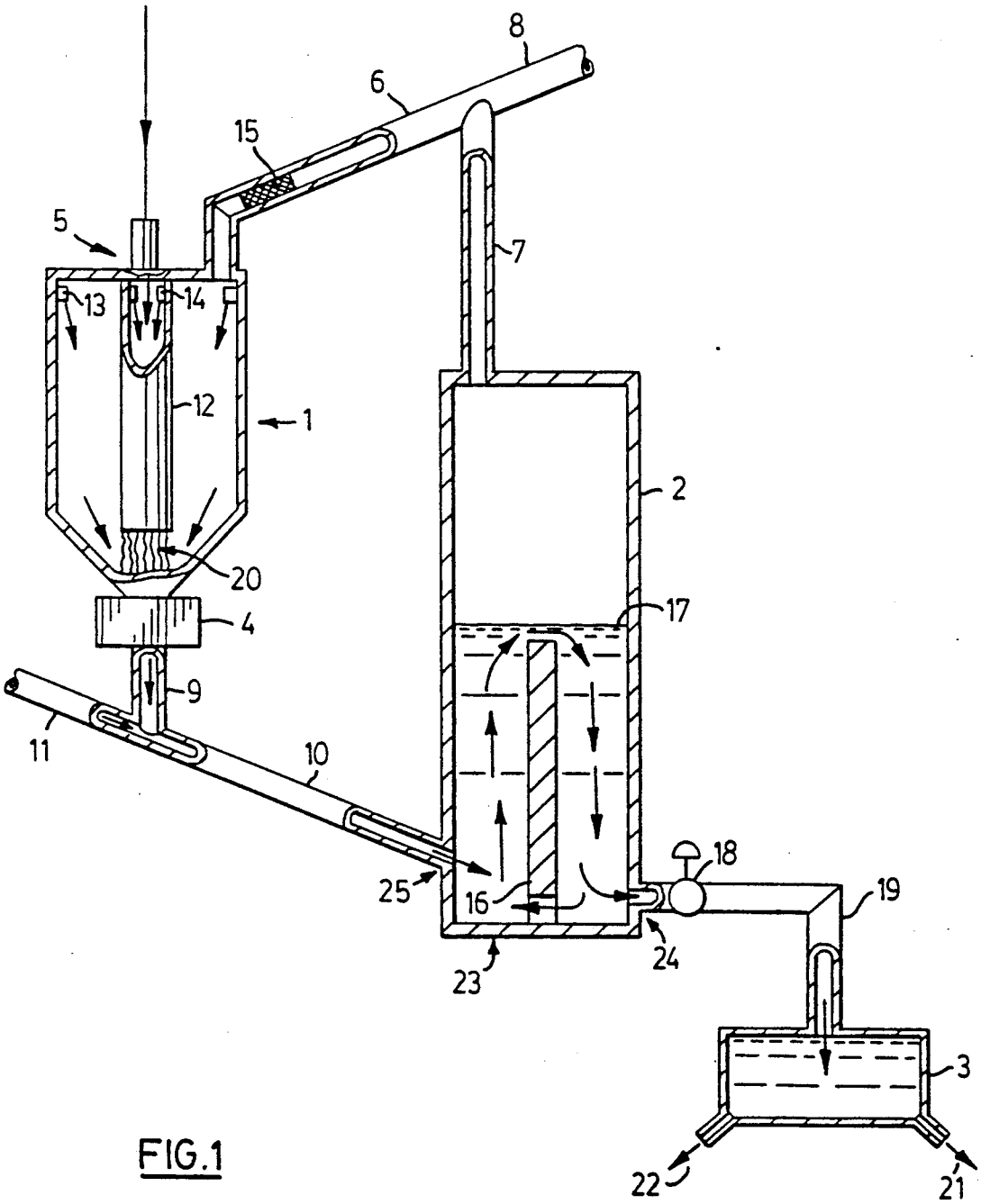

The present invention relates to a coupled spinning and dewatering process in which plexifilamentary film-fibril strands are formed from fibre-forming polyolefins, shredded and dewatered to provide fibre that is in the form of e.g. a polyolefin fibrous pulp material.

As used herein, "plexifilamentary film-fibril strands of polyolefin" means a strand which is characterized as a three dimensional integral network of a multitude of thin, ribbon-like film-like elements of random length and of a thickness in the range of about 1-20 microns, with an average thickness of less than about 10 microns, generally coextensively aligned with the longitudinal axis of the strand. The film-fibril elements intermittently unite and separate at irregular intervals in various places throughout the length, width and thickness of the strand to form the three dimensional network. Such strands are known, being described in further detail in Blades and White, U.S. Pat. No. 3 081 519 which issued Mar. 19, 1963.

Blades and White describe a flash-spinning process for producing plexifilamentary film-fibril strands from fibre-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash spinning causes the liquid to vaporize and thereby cool the plexifilamentary film-fibril strand that forms from the polymer. Preferred polymers include crystalline polyhydrocarbons e.g. polyethylene and polypropylene.

Flash-spinning a polyolefin discrete fibre from a polymer dissolved in a solvent with water added in quantities sufficient to form an emulsion or inverse emulsion is known. For example, Kozlowski, in U.S. Pat. No. 4 054 625 which issued Oct. 18, 1977 teaches a process for the manufacture of discrete fibres from a solution of polymer in an organic solvent and water. Critical to the process of Kozlowski is that the water is present in an amount such that it constitutes a discontinuous phase dispersed as discrete droplets throughout the polymer solution. This "inverse emulsion" is then flash spun to form discrete fibers. Water concentrations of 40 to 50%, far exceeding the solubility of water in the organic solvent, are preferred for the process even though more care in mixing the solution must be exercised to ensure that the water is the discontinuous phase. The resultant discontinuous spinning produces discrete fibres that tend to be relatively coarse and un-oriented, but the production of discrete fibres in a discontinuous spinning process eliminates a need for separate cutting and shredding steps. In contrast, continuous fibres tend to be extremely difficult to convey, especially in water, as there is a tendency for continuous fibres to flock together and form large bundles; continuous fibres must be reduced in average length in order to be readily conveyed.

Commercial spunbonded products made from polyethylene plexifilamentary film-fibril strands have been successfully produced, with the polyethylene being flash-spun from trichlorofluoromethane. Although trichlorofluoromethane has been used extensively for this purpose, that halocarbon has now been implicated as a source of depletion of the earth's ozone. A general discussion of the ozone-depletion problem is presented by P.S. Zurer in "Search Intensifies for Alternatives to Ozone-Depleting Halocarbons", *Chemical & Engineering News,* pages 17-20 (Feb. 08, 1988).

Samuels in U.S. patent application Ser. No. 07/397 177, filed Aug. 22, 1989 now U.S. Pat. No. 5,043,108, describes an improved process for flash-spinning plexifilamentary film-fibril strands, wherein a spin mixture is formed from an organic solvent, polyethylene and a non-solvent, especially water, and then flash-spun at a pressure that is greater than the autogenous pressure of the spin mixture into a region of substantially lower temperature and pressure. The amount of water used is between 0.5% by weight of the organic solvent and an amount equal to the saturation limit of water in the solvent. The amount of polyethylene ranges from 5 to 25% by weight of the polyethylene and organic solvent. The mixing and flash spinning is performed at a temperature in the range of 100° to 250° C. The water, sometimes referred to herein as a spin aid, may be replaced in whole or in part by an alcohol, especially methanol.

In coupled spinning and dewatering processes for making a fibrous material from polyolefins, especially polyethylene, difficulties may be experienced in the spinning zone associated with flashing off and removal of solvent, and subsequently in conveying the fibrous material to and through a stripping zone for removal of residual solvents to the dewatering zone and fibre recovery; the stripping zone is important for safety, including explosive and toxicity hazards, and to reduce pollution. For instance, the fibrous material tends to block and plug transfer lines and vessels used in the transfer of fibrous material from the region of the spin orifice to the dewatering device.

An improved coupled spinning and dewatering process has now been found in which the plexifilamentary film-fibril strands, especially strong oriented fibrils, may be formed, shredded and conveyed from the spin orifice to the dewatering device substantially in the absence of plugging of the apparatus.

Accordingly, the present invention provides a continuous process for the manufacture of a fibrous material from a polyolefin comprising the steps of:

(a) feeding a solution of polyolefin dissolved in an organic solvent at a pressure that is at least autogenous pressure to a spinneret, the exit of the spinneret being the inlet to an elongated vertical tube and being located in an upper section of an elongated vertical vessel, the tube extending for a major portion of the length of the vessel, said vessel being at a lower pressure and temperature than the solution;

(b) passing plexifilamentary film-fibril strands thus formed down the tube to a location above a shredder located at the bottom of the vessel, removing volatile matter from an upper section of the vessel and spraying water both down the tube and into the vessel;

(c) passing strands and water through the shredder without excessive fusing of the strands, thereby converting the strands to discontinuous shredded fibres, said shredder being a self-cleaning self-feeding shredder;

(d) conveying the shredded fibres and water from the shredder to a second vessel, said second vessel having a baffle located between the inlet and outlet thereof such that the shredded fibrous material passes from the inlet, over the baffle and to the outlet of the second vessel, the upper lip of the baffle being located so that the level of water in the second vessel is in substantially the same horizontal plane as the shredder;

(e) feeding an inert gas to the second vessel, especially between the inlet and the baffle thereof, to effect removal of residual volatile matter, said volatile matter being passed through a vapour outlet located in the upper section of the second vessel substantially above the level of the water;

(f) feeding the shredded fibres and liquid passing from the second vessel to a dewatering device, and separating fibres from liquid in the dewatering device; and (g) recovering shredded fibre substantially free of residual solvent.

In a preferred embodiment of the process of the invention, the inert gas in step (e) is steam.

The present invention further provides apparatus for the continuous manufacture of a fibrous material from a polyolefin comprising:

(a) a spinneret adapted for forming plexifilamentary film-fibril strands from a solution of polyolefin dissolved in an organic solvent, the exit to said spinneret being the inlet of an elongated vertical tube and being located in an upper section of an elongated vertical vessel, said tube extending down the vessel for a major portion of the length of the vessel and tube having its exit at a location above the inlet to a shredder located at the bottom of the vessel, said elongated vertical tube being adapted to guide the strands to the shredder, the shredder being a self-feeding self-cleaning shredder;

(b) each of the elongated vessel and the elongated tube having water spray means to facilitate movement of strands and other polymeric material in a downward direction;

(c) tubular conveying means to move discontinuous fibre and water from the shredder to an inlet to a second elongated vertical vessel, said second vessel having an outlet spaced apart from the inlet with a baffle located between said inlet and outlet, the upper lip of the baffle being located so that the level of fibre and water in the second vessel is substantially in the same horizontal plane as the shredder;

(d) means to inject inert gas into the second vessel, especially between the inlet and the baffle;

(e) tubular conveying means to move discontinuous fibre from the second vessel to dewatering apparatus; and (f) each elongated vessel having an outlet for volatile matter located in the upper section thereof.

The present invention also provides a method of measuring orientation of polyolefin fibres comprising immersing said fibres in a liquid at a temperature above the melting point of the polyolefin, said liquid being a liquid that may be heated to a temperature above the melting point of the polyolefin without swelling or dissolving the polyolefin.

The present invention will be described with reference to the embodiment shown in the drawing, in which:

FIG. 1 is a schematic representation of a coupled spinning and dewatering apparatus.

With reference to FIG. 1, elongated first vessel 1 and elongated second vessel 2 are shown in a side by side relationship, with a vertical orientation. First vessel 1 has a spinneret 5 located in the upper section of the vessel; an example of a spinneret is described in the examples hereinafter. Spinneret 5 is adapted to receive a solution of polyolefin in organic solvent at elevated temperature and pressure, from a source that is not shown, and to form plexifilamentary film-fibril strands on passage of the solution through spinneret 5. The pressure used is at least the autogenous pressure. The exit of spinneret 5 is the inlet to tube 12. Tube 12 preferably abuts spinneret 5, without direct passage to elongated first vessel 1, other than through its exit, to reduce problems associated with separation of fibre and solvent. Tube 12 extends from the exit of spinneret 5 in a vertical direction for a major portion of the length of the elongated vessel, to a location above but spaced apart from shredder 4. First vessel 1 is shown as tapering towards the inlet of shredder 4, which is located at the bottom of elongated first vessel 1. Shredder 4 contains blades (not shown) for shredding the plexifilamentary film-fibril strands, to form fibrous material, which may be referred to herein as discontinuous fibre. Shredder 4 should be a self-feeding self-cleaning shredder.

Elongated first vessel 1 has water spray inlets located, preferably circumferentially located, in the upper section of first vessel 1. Spray inlet 13 is located around the periphery of elongated vessel 1, and spray inlet 14 is located within tube 12, adjacent to spinneret 5.

The outlet from shredder 4 is connected to outlet pipe 9, which in the embodiment shown is joined to eductor pipe 11 to form transfer pipe 10. Transfer pipe 10 is connected to second vessel 2 at a lower section thereof, at second vessel inlet 25. Second vessel 2 has outlet 24 located on the opposite side of the vessel from inlet 25. Inlet 25 and outlet 24 are separated by intervening baffle 16.

Baffle 16 preferably extends substantially to the bottom of second vessel 2 but is spaced apart therefrom to promote mixing of liquid within second vessel 2. Baffle 16 extends vertically upwards in second vessel 2 to a location such that the lip of baffle 16 is just below the horizontal plane of shredder 4, especially the plane of the blades of shredder 4. The lip of baffle 16 is shown as located such that the water level in second vessel 2 is in the same plane as shredder 4, especially the blades of shredder 4. It is believed to be important that the water level not be above shredder 4 as the polyolefin strands would tend to float on the water above shredder 4 and cause feeding problems to shredder 4. Furthermore, it is preferred that the water level not be below shredder 4, to prevent solvent vapours from entering elongated first vessel 1 from second vessel 2 and to reduce fusion of the fibrous material during shredding.

Second vessel 2 has an inlet 23 for passage of inert gas into second vessel 2. The preferred inert gas is steam, especially as use of steam facilitates recovery of solvent for recycle within the process and water is used as the medium for conveying of fibrous material.

The flow of fluid from second vessel 2 is controlled by outlet valve 18 e.g. a rubber core pinch valve, in transfer pipe 19, through which water and discontinuous fibre pass to dewatering device 3. Dewatering device 3 has an outlet for liquid and an outlet for the discontinuous fibre, schematically shown as 21 and 22, respectively.

The upper sections of first vessel 1 and second vessel 2 have outlets for volatile matter, especially the organic solvent, which are attached to outlet pipes 6 and 7, respectively. Outlet pipes 6 and 7 are shown as connected to form pipe 8. Outlet pipe 6 is shown as having a filter 15 for retention of fibrous material that may enter outlet pipe 6.

In operation, polyolefin is dissolved in an organic solvent. The polyolefin may be in the form of pellets or powder, or other forms known in the art, having been previously polymerized from monomers. Alternatively, and in preferred embodiments of the process, the polyolefin is already dissolved in an organic solvent e.g. it is a solution of polymer in organic solvent from a process for the polymerization of monomers.

The polyolefin may be a high molecular weight homopolymer of ethylene or copolymer of ethylene and at least one $C_4$–$C_{10}$ hydrocarbon alpha-olefin e.g. butene-1, hexene-1 and/or octene-1. In other embodiments, the polyolefin is a homopolymer of propylene or copolymer of propylene with a minor amount of ethylene. A wide variety of such polymers, including by type of monomer(s) used, molecular weight, molecular weight distribution and other properties are commercially available. In preferred embodiments in which the polyolefin is a homopolymer of ethylene or copolymer of ethylene and at least one $C_4$–$C_{10}$ hydrocarbon alpha-olefin, the density is in the range of 0.930 to 0.965 g/cm$^3$, especially in the range of 0.940 to 0.960 g/cm$^3$. The melt index of the polyolefin is preferably less than 12 dg/min i.e. in the range of from so-called "no-flow" e.g. less than about 0.01 dg/min, to 12 dg/min, especially in the range of 0.30 to 1.0 dg/min; melt index is measured by the method of ASTM D-1238 (condition E).

A variety of organic solvents may be used in the process, examples of which include pentane, hexane, cyclohexane, heptane, octane, methyl cyclohexane and hydrogenated naphtha, and related hydrocarbon solvents.

The polyolefin may contain additives e.g. antioxidants, ultra violet stabilizers, wetting agents, surfactants and other additives known for use in polyolefins, provided that the additives are capable of passing through the orifice used in the process and not otherwise adversely affecting the process.

The solution of polyolefin in organic solvent is at an elevated temperature and pressure, the solution being at a pressure that is at least the autogenous pressure and at a temperature sufficient to maintain the polyolefin in solution. In preferred embodiments, the solution also contains a non-solvent e.g. water, as a spinning aid, as described in the aforementioned patent application of Samuels. The spinning aid may contain wetting agents, surfactants or the like. The temperature and pressure used affect the properties of the film-fibril strands obtained on spinning and consequently the fibrous material subsequently formed in the process. For instance, the temperature and pressure may be selected so that highly oriented fibres are obtained, such fibres being preferred.

The solution is fed to spinneret 5, to form plexifilamentary film-fibril strands. These strands are formed at the inlet to tube 12, or within tube 12, and pass down tube 12 towards shredder 4. Water is sprayed down tube 12, to assist in passage of the strands down tube 12.

Water is also sprayed into the elongated vessel 1, but outside tube 12, especially to clean the walls of elongated vessel 1, and prevent an accumulation of polyolefin fibre fines on the walls of elongated vessel 1. Such an accumulation leads to plugging of the outlet for volatile matter, 6. In embodiments, the water sprayed into tube 12 or otherwise into elongated vessel 1 contains surfactants, wetting agents or viscosity building agents, one example of which is polyvinyl alcohol.

The strands are fed into shredder 4. The level of water in shredder 4 is maintained at no higher than the shredder, as the strands are lighter than water and tend to float, in order to reduce problems in feeding the strands to the shredder; in the embodiment shown, the control of the level of water (liquid) in shredder 4 is primarily a function of the position of baffle 16 in second vessel 2, and operation of outlet or control valve 18. The shredder converts the strands into discontinuous fibres. Shredder 4 should be operated so as to prevent fusing together of the discontinuous fibres formed in shredder 4.

The mixture passing from shredder 4 is a mixture comprised of discontinuous polyolefin fibres, water and residual organic solvent; a substantial portion of the organic solvent has previously passed from elongated vessel 1 through outlet 6.

The mixture passing from shredder 4 is conveyed to second vessel 2. In second vessel 2, the mixture is forced to pass over a baffle 16, which is intended to increase contact of the mixture with water and to permit removal of residual volatile matter, especially organic solvent, from the fibres. An inert sparging gas, especially steam, is injected into second vessel 2, especially in the area between the inlet to second vessel 2 and baffle 16; volatile matter passes from second vessel 2 through an outlet 7 located in the upper portion of the vessel. The upper lip of baffle 16 is located so that the level of liquid and fibre in second vessel 2 is in the same plane as shredder 4, especially that of the blades of shredder 4.

The mixture of liquid and fibre passes from second vessel 2, through a valve, to a dewatering device, an example of which is a belt filter press. In the dewatering device, the fibre is separated from the liquid. The fibre obtained is substantially free of organic solvent. The water obtained is preferably heated and recycled back to elongated vessel 1.

It is to be understood that the surfaces of pipes, vessels and the like used in the process of the invention should be free of snag points or other obstructions that might prevent or retard the passage of the film-fibrils or fibrous material.

The fibre obtained is in the form of plexifilamentary film-fibrils in a discontinuous form. If the polyolefin is polyethylene, the fibre may be described as a polyethylene pulp. As such, it has a variety of uses. For instance, the fibre may be used as part of diapers and incontinence products, as a filler e.g. in polymers, cement and the like, and as synthetic paper.

The orientation of polyolefin fibres may be measured by immersing the fibres in a liquid at a temperature above the melting point of the polyolefin. The liquid is a liquid that may be heated to a temperature above the melting point of the polyolefin without swelling or dissolving the polyolefin. For instance, the liquid may be an alkylene glycol e.g. ethylene glycol. The time and temperature should be such that the fibres are shrunk without melting or other type of distortion of the sample being tested. In preferred embodiments, the period of time of immersion is from 3–6 seconds and the temperature is 150°–160° C. In other embodiments, the fibres are a plurality of fibres of irregular length e.g. in the form of a pulp or other oriented fibres of irregular length.

The present invention is further illustrated by the following examples:

EXAMPLE I

Fibrous material was manufactured using semi-works scale apparatus substantially as shown in FIG. 1. The solution of polymer fed to the spinneret was a solution of ethylene/butene-1 copolymer having a density of 0.947 g/cm$^3$ and a melt index of 3.3 dg/min, dissolved in cyclohexane. The solution had a temperature of 254° C. and a polymer concentration of 16.1% by weight. The flow rate of the solution to the spinneret was 260 kg/hr, and the pressure differential across the letdown orifice of the spinneret, into a pressure letdown chamber, was 1.9 MPa; the spinneret was comprised of a letdown or inlet orifice followed by a letdown chamber and then a spin orifice. The spinneret had a single spin orifice with a diameter of 1.60 mm.

The spin vessel was at a temperature of 90° C. and was operated at a pressure of 14 kPa. Water at a temperature of 96° C. was used, being fed to the spin vessel at a rate of 114 liters/min, to the spin tube at a rate of 45.5 liters/minute and to the eductor subsequent to the cutter at a rate of 68.3 liters/minute.

The stripper, which contained a baffle as shown in FIG. 1, was operated at a temperature of 100° C. Steam was injected into the stripper at a rate of 200 kg/hr.

Product was directed into the spin vessel throat, conveyed through the stripper vessel and recovered with a belt filter press. The recovered product was essentially free of residual solvent.

It was found that the process could be operated in a continuous manner over extended periods of time, without any plugging of filters in the overhead lines. The particle size of the product was in the range of 20–30 microns in length by 100 microns in width.

EXAMPLE II

The procedure of Example I was repeated using a homopolymer of ethylene, a higher solution temperature, a lower solution pressure that was slightly below the phase boundary pressure and using a spin aid (water) at a concentration slightly below the solubility limit of the spin aid in the solvent.

The solution of polymer fed to the spinneret was a solution of ethylene homopolymer having a density of 0.960 g/cm$^3$ and a melt index of 0.70 dg/min, dissolved in cyclohexane. The solution had a temperature of 259° C. and a polymer concentration of 14.6% by weight. The flow rate of the solution to the spinneret was 225 kg/hr, and the pressure differential across the inlet orifice of the spinneret, into a pressure letdown chamber, was 1.14 MPa. The spinneret had a single orifice with a diameter of 1.60 mm. The concentration of spin aid was 6.7% by weight and it was fed to the solution at a temperature of 240° C.

The spin vessel and the stripper were operated in the same manner as in Example I.

Fibres recovered were essentially free of solvent. The fibres exhibited a linear shrinkage of 9.6, a diameter range of 1–20 microns and a handsheet zero-span of 5.1 kg/15mm. Linear shrinkage is measured by submerging a bundle of fibres in ethylene glycol at 155° C. for 5 seconds, and is expressed as the ratio of initial length to shrunken length; linear shrinkage is an indication of the amount of molecular orientation imparted to the fibres during spinning.

Handsheet zero-span was measured as follows: a handsheet of basis weight 60 g/m$^2$ was prepared by opening up a fibre sample, recovered from the belt filter press, in water in a Waring Blender, then dewatering in a standard handsheet mould and drying. The zero-span apparatus used was a Pulmac Troubleshooter and the units are the pressure required to break a standard sample strip measuring 2.54 cm × 10 cm, using the method recommended by Pulmac. The jaw width was 15 mm and the jaw separation was 0 mm. The handsheet was tested in a dry condition.

EXAMPLE III

The procedure of Example II was repeated using an ethylene/butene-1 copolymer having a density of 0.941 g/cm$^3$ and a melt index of 0.36 dg/min. The solution had a temperature of 260° C. and a polymer concentration of 12.0% by weight. The flow rate of the solution to the spinneret was 275 kg/hr, and the pressure differential across the inlet orifice, into a pressure letdown chamber, was 1.45 MPa. The spinneret had a single orifice with a diameter of 1.60 mm. The concentration of spin aid was 6.4% by weight and it was fed to the solution at a temperature of 240° C.

Fibres recovered were essentially free of solvent. The fibres exhibited a linear shrinkage of 9.6, a diameter range of 1–20 microns and a handsheet zero-span of 4.4 kg/15mm.

The fibres of Examples II and III are considered to be strong fine fibres for the polymer used in the process.

EXAMPLE IV

The procedure of Example II was repeated using an ethylene/butene-1 copolymer having a density of 0.943 g/cm$^3$ and a melt index of 0.33 dg/min. The solution had a temperature of 247° C. and a polymer concentration of 14.2% by weight. The flow rate of the solution to the spinneret was 280 kg/hr, and the pressure differential across the inlet orifice, into a pressure letdown chamber, was 1.3 MPa. However, in this Example, the spinneret had 19 orifices, each with a diameter of 0.38 mm, to give the same cross-sectional area as the spinneret used in Example II. The concentration of spin aid was 6.4% by weight and it was fed to the solution at a temperature of 240° C.

Fibres were recovered at the outlet of the belt filter press, essentially free of solvent. The fibres had a linear shrinkage of 9.9, a diameter range of 1–30 microns and a handsheet zero-span strength of 6.6 kg/15mm.

EXAMPLE V

The procedure of Example I was repeated, but with a number of alterations to the apparatus used. The apparatus did not have a baffle in the stripper, an eductor was not used, a spin tube was not used and the shredder was not a self-feeding shredder.

The solution of polymer fed to the spinneret was a solution of ethylene/butene-1 copolymer having a density of 0.959 g/cm$^3$ and a melt index of 0.45 dg/min, dissolved in cyclohexane. The solution had a temperature of 240° C. and a polymer concentration of 14.5% by weight. The flow rate of the solution to the spinneret was 245 kg/hr, and the pressure differential across the inlet orifice, into a pressure letdown chamber, was 1.4 MPa. The spinneret had a single orifice with a diameter of 1.60 mm. A spin aid (water) was used at a concentration of 6.0% by weight and it was fed to the solution at a temperature of 240° C.

The spin vessel had a temperature of 90° C. and was operated at a pressure of 14 kPa. Water at a temperature of 96° C. was used, being fed to the spin vessel at a rate of 67.5 liters/min.

The stripper was operated at a temperature of 100° C. Steam was injected into the stripper at a rate of 175 kg/hr.

Product was primarily recovered from the spin vessel, not from the belt filter press. Fibres that were conveyed to the stripper floated on top of the water in that vessel, with only a small amount of fibre reaching the belt filter press. Thus, the process as operated had major deficiencies in conveying of fibres from the spinneret to the belt filter press.

EXAMPLE VI

The procedure as used in Example I was repeated, but without a self-feeding shredder or a spin tube. The solution of polymer fed to the spinneret was a solution of a homopolymer of ethylene having a density of 0.960 g/cm$^3$ and a melt index of 0.68 dg/min, dissolved in cyclohexane. The solution had a temperature of 246° C. and a polymer concentration of 14.3% by weight. The flow rate of the solution to the spinneret was 280 kg/hr, and the pressure differential across the inlet orifice, into a pressure letdown chamber, was 3.65 MPa. The spinneret had a single orifice with a diameter of 2.16 mm. A spin aid (water) was used at a concentration of 2.9% by weight and it was fed to the solution at a temperature of 246° C.

The spin vessel had a temperature of 90° C. and was operated at a pressure of 14 kPa. Water at a temperature of 96° C. was used, being fed to the spin vessel at a rate of 159 liters/min and to the eductor subsequent to the cutter at a rate of 68.3 liters/minute.

The stripper, which contained a baffle as shown in FIG. 1, was operated at a temperature of 100° C. Steam was injected into the stripper at a rate of 200 kg/hr.

Product was directed into the spin vessel throat, conveyed through the stripper vessel and recovered with the belt filter press. The recovered product was essentially free of residual solvent. However, it was found that conveying problems persisted until the shredder was replaced with a self-feeding shredder. The process could then be operated continuously, but for limited periods of time in that fibres plugged the overhead filters from the spin chamber; this problem may be alleviated by use of the spin tube.

We claim:

1. A continuous process for the manufacture of a fibrous material from a polyolefin comprising the steps of:

(a) feeding a solution of polyolefin dissolved in an organic solvent at a pressure that is at least autogenous pressure to a spinneret, the exit of the spinneret being the inlet to an elongated vertical tube and being located in an upper section of an elongated vertical vessel, the tube extending for a major portion of the length of the vessel, said vessel being at a lower pressure and temperature than the solution;

(b) passing plexifilamentary film-fibril strands thus formed down the tube to a location above a shredder located at the bottom of the vessel, removing volatile matter from an upper section of the vessel and spraying water both down the tube and into the vessel;

(c) passing strands and water through the shredder without excessive fusing of the strands, thereby converting the strands to discontinuous shredded fibres, said shredder being a self-cleaning self-feeding shredder;

(d) conveying the shredded fibres and water from the shredder to a second vessel, said second vessel having a baffle located between the inlet and outlet thereof such that the shredded fibrous material passes from the inlet, over the baffle and to the outlet of the second vessel, the upper lip of the baffle being located so that the level of water in the second vessel is in substantially the same horizontal plane as the shredder;

(e) feeding an inert gas to the second vessel to effect removal of residual volatile matter, said volatile matter being passed through a vapour outlet located in the upper section of the second vessel substantially above the level of the water;

(f) feeding the shredded fibres and liquid passing from the second vessel to a dewatering device, and separating fibres from liquid in the dewatering device; and (g) recovering shredded fibre substantially free of residual solvent.

2. The process of claim 1 in which, in step (e), the inert gas is fed between the inlet and the baffle of the second vessel.

3. The process of claim 2 in which, in step (e), the inert gas is steam.

4. The process of claim 3 in which the film-fibril strands are oriented fibrils.

5. The process of claim 3 in which the polyolefin is a high molecular weight homopolymer of ethylene or copolymer or ethylene and at least one $C_4$–$C_{10}$ hydrocarbon alpha-olefin.

6. The process of claim 3 in which the polyolefin is a homopolymer of propylene or copolymer of propylene with a minor amount of ethylene.

7. The process of claim 5 the density is in the range of 0.930 to 0.965 g/cm$^3$ and the melt index is less than 12 dg/min.

8. The process of claim 7 in which the density is in the range of 0.940 to 0.960 g/cm$^3$ and the melt index is in the range of 0.30 to 1.0 dg/min.

9. The process of claim 3 in which the solution fed to the spinneret is admixed with a spin aid.

10. The process of claim 9 in which the spin aid is water.

* * * * *